US009121603B2

(12) United States Patent
Wetzl et al.

(10) Patent No.: US 9,121,603 B2
(45) Date of Patent: Sep. 1, 2015

(54) COMBUSTION CHAMBER ASSEMBLY AND IGNITION ELEMENT THEREFOR

(75) Inventors: Andreas Wetzl, Wernau (DE); Wolfgang Pfister, Esslingen (DE)

(73) Assignee: Eberspaecher Climate Control Systems GmbH & Co. KG, Esslingen (DE)

( * ) Notice: Subject to any disclaimer, the term of this patent is extended or adjusted under 35 U.S.C. 154(b) by 935 days.

(21) Appl. No.: 13/286,532

(22) Filed: Nov. 1, 2011

(65) Prior Publication Data

US 2012/0104109 A1 May 3, 2012

(30) Foreign Application Priority Data

Nov. 2, 2010 (DE) ..... 10 2010 043 222

(51) Int. Cl.

| | |
|---|---|
| ***F23D 11/42*** | (2006.01) |
| ***F23D 3/40*** | (2006.01) |
| ***F23Q 7/06*** | (2006.01) |
| *B60H 1/22* | (2006.01) |
| *F16B 21/06* | (2006.01) |
| *F23Q 5/00* | (2006.01) |

(52) U.S. Cl.

CPC *F23D 11/42* (2013.01); *F23D 3/40* (2013.01); *F23Q 7/06* (2013.01); *F23D 2207/00* (2013.01); *F23D 2900/21002* (2013.01); *F23N 2035/12* (2013.01)

(58) Field of Classification Search

CPC ..... F23D 11/42; F23D 2207/00; F23Q 7/06; F23Q 7/10; F23Q 3/008; F23Q 9/045; F24C 3/103

USPC ..... 431/264, 258, 263; 123/309, 608, 647, 123/169 R, 169 PA

See application file for complete search history.

(56) References Cited

U.S. PATENT DOCUMENTS 2,505,596 A * 4/1950 Weiler ..... 431/264
2,964,103 A * 12/1960 Ryder ..... 431/114

(Continued)

FOREIGN PATENT DOCUMENTS

CN 1386182 A 12/2002
CN 101353999 A 1/2009

(Continued)

OTHER PUBLICATIONS

"DE_10229852_C1_M—Mach Trans.pdf"; Machine Translation—DE_10229852_C1; http://www.epo.org; Sep. 27, 2014.*

(Continued)

*Primary Examiner* — Gregory Huson
*Assistant Examiner* — Daniel E Namay
(74) *Attorney, Agent, or Firm* — McGlew and Tuttle, P.C.

(57) ABSTRACT

A combustion chamber assembly, especially for a vehicle heater, includes a combustion chamber housing (12) with a housing wall (16) surrounding a combustion chamber. At least one ignition element opening (28) is provided in the area of the housing wall (16) and an ignition element (30) is fixed in a fastening area (44) in at least one ignition element opening (28). The at least one ignition element opening (28) is designed with a circular wedge inner profile (54) and the fastening area of the ignition element fastened in this opening is designed with a circular wedge outer profile and fasteningly meshes with the circular wedge inner profile (54).

20 Claims, 2 Drawing Sheets

(56) References Cited

U.S. PATENT DOCUMENTS

| | | | | | |
|---|---|---|---|---|---|
| 3,536,428 | A | * | 10/1970 | Beesch | 431/264 |
| 4,121,419 | A | * | 10/1978 | Kuznetsov et al. | 60/39.826 |
| 4,536,151 | A | * | 8/1985 | Langen et al. | 431/1 |
| 4,576,617 | A | * | 3/1986 | Renevot | 95/279 |
| 5,275,551 | A | * | 1/1994 | Ejiri et al. | 431/1 |
| 5,894,988 | A | * | 4/1999 | Brenner et al. | 431/6 |
| 6,929,467 | B2 | * | 8/2005 | Blaschke et al. | 431/261 |
| 8,091,352 | B2 | * | 1/2012 | McCoy et al. | 60/303 |
| 2003/0022123 | A1 | | 1/2003 | Wolf et al. | |
| 2004/0013990 | A1 | | 1/2004 | Haefner et al. | |

FOREIGN PATENT DOCUMENTS

| | | | | | |
|---|---|---|---|---|---|
| DE | 15 51 681 | A | | 3/1970 | |
| DE | 1551681 | A1 | * | 3/1970 | |
| DE | 4327461 | A1 | * | 10/1994 | F16B 19/02 |
| DE | 29 802 226 | U1 | | 4/1998 | |
| DE | 29802226 | U1 | * | 4/1998 | |
| DE | 19945097 | A1 | * | 3/2001 | |
| DE | 102 29 852 | C1 | | 10/2003 | |
| DE | 10213214 | A1 | * | 10/2003 | F16D 1/08 |
| DE | 10229852 | C1 | * | 10/2003 | |
| DE | 103 33 786 | A1 | | 2/2005 | |
| DE | 10333786 | A1 | * | 2/2005 | F02M 61/14 |
| DE | 10 2005 055 642 | A1 | | 5/2007 | |
| DE | 199 45 097 | B4 | | 4/2008 | |
| DE | 10 2008 047 017 | A1 | | 3/2010 | |
| DE | 102008047017 | A1 | * | 3/2010 | |
| DE | 10 2008 053 959 | A1 | | 5/2010 | |
| DE | 102008053959 | A1 | * | 5/2010 | |
| DE | 10 2009 035 831 | A1 | | 9/2010 | |
| DE | 102009035831 | A1 | * | 9/2010 | |
| EP | 542571 | A2 | * | 5/1993 | |
| EP | 1291535 | A1 | * | 3/2003 | F16B 21/02 |

OTHER PUBLICATIONS

DE_10333786_A1_M—Mach Trans.pdf; Machine Translation—DE_10333786_A1; http://www.epo.org; Sep. 27, 2014.*

DE_102008047017_A1_M—Mach Trans.pdf; Machine Translation—DE_102008047017_A1; http://www.epo.org; Sep. 27, 2014.*

DE_102008053959_A1_M—Mach Trans.pdf; Machine Translation—DE_102008053959_A1; http://www.epo.org; Sep. 27, 2014.*

Chinese Office Action of Apr. 17, 2015.

* cited by examiner

Fig. 3
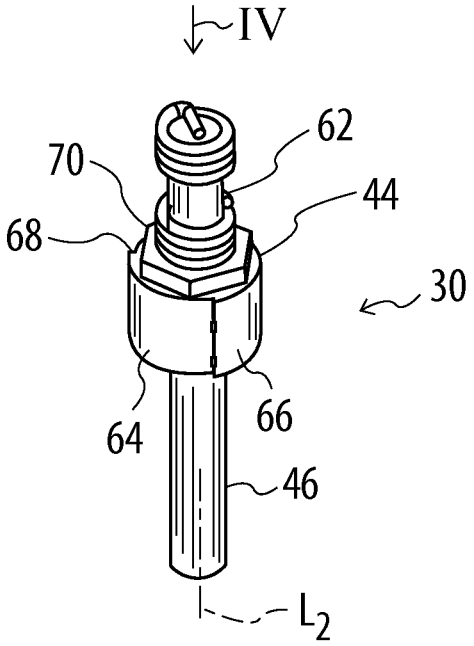
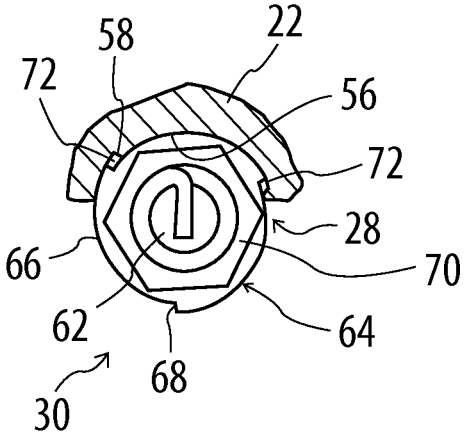
Fig. 4

COMBUSTION CHAMBER ASSEMBLY AND IGNITION ELEMENT THEREFOR

CROSS REFERENCE TO RELATED APPLICATIONS

This application claims the benefit of priority under 35 U.S.C. §119 of German Patent Application DE 10 2010 043 222.9 filed Nov. 2, 2010, the entire contents of which are incorporated herein by reference.

FIELD OF THE INVENTION

The present invention pertains to a combustion chamber assembly, especially a vehicle heater, comprising a combustion chamber housing with a housing wall surrounding a combustion chamber, wherein at least one ignition element opening is provided in the area of the housing wall and an ignition element with a fastening area is fixed in at least one ignition element opening.

BACKGROUND OF THE INVENTION

Such a combustion chamber assembly, known from DE 10 2005 055 642 A1, is shown in FIG. 1. The combustion chamber assembly 110 comprises a combustion chamber housing 112 with a housing wall 116 surrounding a combustion chamber 114. This housing wall 116 comprises an approximately cylindrically shaped circumferential wall 118 and a bottom wall. The circumferential wall 118 and the bottom wall 120 may be provided as an integrally designed, pot-shaped component, but they may also be provided as separate areas or assemblies and connected to one another.

An ignition element mounting attachment 122 is provided at the circumferential wall 118. This mounting attachment 122 is open in the area of a first end 124 towards the combustion chamber 114 formed in the combustion chamber housing 112. At an end 126 of the mounting attachment 122, away from the circumferential wall 118, the ignition element mounting attachment 122 carries an ignition element 130 extending in the ignition element opening 128 formed in the ignition element mounting attachment 122, for example, a glow plug.

The inner surface of the circumferential wall 118 and also the inner surface of the ignition element mounting attachment 122 are lined with a porous evaporator medium 132 and 134, respectively. The porous evaporator medium 134 of the ignition element mounting attachment 122 and the porous evaporator medium 132 of the circumferential wall 118 are in connection with one another in the area of an opening 136, in the area of which the ignition element opening 128 of the ignition element mounting attachment 120 is open towards the combustion chamber 114. A fuel feed line 138 feeds liquid fuel in the area of the ignition element mounting attachment 122 into the porous evaporator medium 134 provided there. The liquid fuel is distributed in the inner volume area of this porous evaporator medium 134 under capillary delivery action and also under the force of gravity and it also enters the porous evaporator medium 132. Fuel can be discharged for combustion with combustion air at the surfaces of the porous evaporator media 132, 134, which surfaces are exposed to the ignition element opening 128 or to the combustion chamber 114. To feed this combustion air, a combustion air feed opening 140, opposite which, for example, a passage opening 142 may be located in the porous evaporator medium 134, is provided, for example, in the ignition element mounting attachment 122. A plurality of such openings 140 and 142, respectively, may, of course, also be provided here. It is also possible to provide additional combustion air inlet openings in the housing wall, i.e., in the circumferential wall 118 and/or bottom wall 120.

In an end area located at the end 126 of the ignition element mounting attachment 122, the ignition element 130 has a fastening area 144. This is fixed in the ignition element mounting attachment 122 or at the end 126 thereof, for example, by a screw connection. Starting from the fastening area 144, an ignition area 146 extends in the ignition element opening 128 stretched out long in the ignition element mounting attachment 122. An electric connection line 148, via which the electric current necessary for exciting a glow coil, which is provided in the ignition area 146 and is indicated in FIG. 1, can be fed, extends from the fastening area 144 outside the ignition element mounting attachment 122.

SUMMARY OF THE INVENTION

An object of the present invention is to provide a combustion chamber assembly, especially for a vehicle heater, in which stable fastening of at least one ignition element at a combustion chamber housing is nevertheless achieved despite a simplified design.

This object is accomplished according to the present invention by a combustion chamber assembly, especially for a vehicle heater, comprising a combustion chamber housing with a housing wall surrounding a combustion chamber, wherein at least one ignition element opening is provided in the area of the housing wall and an ignition element with a fastening area is fixed in at least one ignition element opening.

Provisions are made, furthermore, for at least one ignition element opening to be designed with a circular wedge inner profile and the fastening area of the ignition element fastened in this ignition element opening is designed with a circular wedge outer profile and it fasteningly meshes with the circular wedge inner profile.

The fastening of at least one ignition element in an ignition element opening is achieved in the design by the cooperation of two complementary circular wedge profiles. These can be manufactured in a markedly simpler manner than, for example, threaded formations. However, based on the self-locking fastening action of such circular wedge profiles, stable fixation is guaranteed, which also cannot be detached by vibrations. It is nevertheless possible to detach the two circular wedge profiles meshing with one another in a fastening manner by acting on them by means of a tool, for example, in order to perform maintenance or to replace a defective ignition element.

At least one ignition element opening, especially an ignition element opening in the area of which an ignition element is fastened, may be provided in the area of a circumferential wall of the housing wall.

To create favorable ignition conditions comparatively rapidly especially during a start phase, i.e., at the beginning of the combustion, provisions are made, furthermore, for providing an ignition element mounting attachment open towards the combustion chamber at the housing wall and for an ignition element opening to be formed in at least one ignition element mounting attachment.

It is advantageous in respect to the ignition conditions, on the one hand, and the easiest possible embodiment, on the other hand, if the at least one ignition element mounting attachment is designed with a circular wedge inner profile at least in its end area located away from the housing wall.

It is advantageous, especially during the start phase of the combustion, if the combustion air necessary for the combustion is introduced in an area close to the ignition element. Provisions may, furthermore, be made for this for forming at least one combustion air inlet opening between a circular wedge inner profile and a circular wedge outer profile that fasteningly meshes with same. Consequently, the openings present in the fastened state in the complementary circular wedge profiles that fasteningly mesh with one another are also used according to the present invention to introduce combustion air at the same time. Thus, it is not necessary to seal openings by additional constructional measures.

The present invention pertains, furthermore, to an ignition element, which can be used, for example, in the combustion chamber assembly according to the present invention, comprising a fastening area and an ignition area, wherein a circular wedge outer profile is provided at the fastening area.

The design may be such that the fastening area forms an end area of the ignition element and the ignition area extends beginning from the fastening area.

Furthermore, the present invention pertains to a vehicle heater, comprising a combustion chamber assembly according to the present invention and/or at least one ignition element according to the present invention.

The present invention will be described below in detail with reference to the figures attached. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 3 is a perspective view of an ignition element for the combustion chamber assembly shown in FIG. 2; and FIG. 4 is a view of the ignition element shown in FIG. 3 in direction of view IV in FIG. 3 in connection with a section of an ignition element mounting attachment.

DESCRIPTION OF THE PREFERRED EMBODIMENTS

Figure 2:
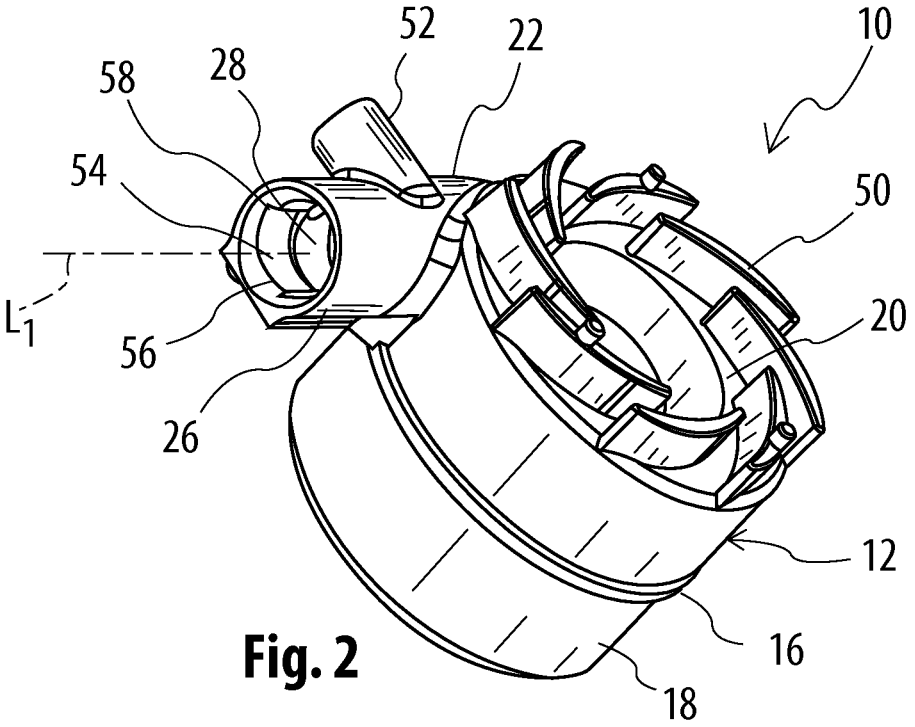
FIG. 2 is a perspective view of a combustion chamber assembly or of a combustion chamber housing therefor.

Referring to the drawings in particular, FIG. 2 shows a combustion chamber assembly 10 designed according to the present invention or a housing 12 therefor. The housing wall 16 with the circumferential wall 18 and with the bottom wall 20 is recognized, at which blade-like combustion air guiding elements 50 are provided in the exemplary embodiment being shown to generate an active flow admission in the combustion air to be introduced into the combustion chamber not recognizable in FIG. 2.

Figure 1:
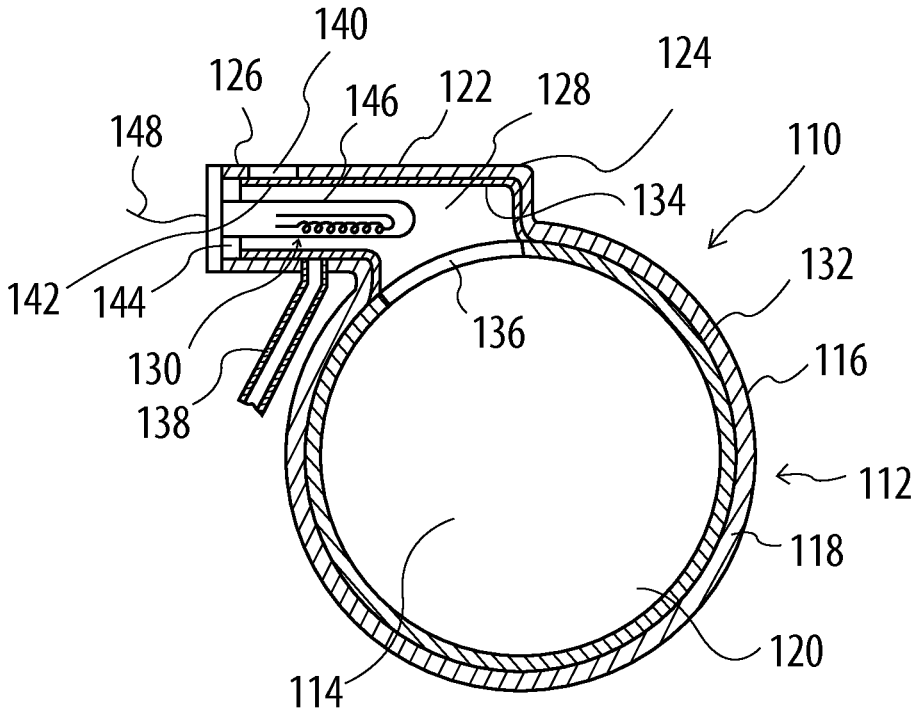
Fig. 1 (Prior Art)
FIG. 1 is a sectional view of a combustion chamber assembly with an ignition element.

Furthermore, the ignition element mounting attachment 22, which extends approximately tangentially from the circumferential wall 18 and which is open at its end 26 located in front of the circumferential wall 18 is seen. A lateral connecting branch 52 branches off from the ignition element mounting attachment 22. The fuel feed line 138 shown in FIG. 1 in the state of the art may open into this connecting branch 52.

The internal structure of the combustion chamber housing 12 in FIG. 2 may correspond to the internal structure of the combustion chamber housing 12 that is described above with reference to FIG. 1, so that reference is made to the descriptions given above.

The ignition element mounting opening 28 of the ignition element mounting attachment 22, which said mounting opening can be recognized in FIG. 2, is provided with a circular wedge inner profile 54 in the area of end 26. This inner profile 54 comprises a plurality of ramp areas 56, which extend in an approximately circular pattern around a central longitudinal axis L1, and which pass over into one another at respective step areas 58 to provide the circular wedge inner profile. Such a ramp area can be characterized, for example, in that its distance of a surface to the central longitudinal axis L1 decreases, for example, continuously beginning from the abrupt or stepped distance reduction generated at a respective step area 58 until an abrupt or stepped reduction of the distance to the central longitudinal axis L1 occurs again at the step area 58 following next in the circumferential direction.

FIG. 3 shows an ignition element 30 to be mounted in the ignition element mounting attachment 22. This ignition element 30 comprises a fastening area generally designated by 44 and an ignition area 46, which extends in the ignition element mounting opening 28 along the ignition element mounting attachment 22, and in which, for example, an electrically excitable glow coil may be provided. A contact terminal area 62 may be provided for the electrical contacting on the side of the fastening area 44, which said side is the opposite side relative to the ignition area 46. Fastening area 44 is provided with a circular wedge outer profile 64 complementary to the circular wedge inner profile 54. This circular wedge outer profile 64 also comprises a plurality of ramp areas 66, three in the example being shown, which pass over into each other in respective step areas 68. The circular wedge outer profile 64 with its ramp areas 66 extends approximately circularly around a central longitudinal axis L2 of the ignition element 30 here as well, which said central longitudinal axis essentially coincides with the central longitudinal axis L1 thereof in a state in which the ignition element 60 is mounted in the ignition element mounting attachment 22. The ramp areas 66 are also characterized in this circular wedge outer profile, for example, in that, beginning from an abrupt or stepped increase in the distance of an outer surface to the central longitudinal direction L2, this distance will then decrease, for example, continuously in the circumferential direction until an abrupt or stepped increase in the distance of the outer circumferential surface occurs again at the step area 68 following next in the circumferential direction.

Due to the complementary design of the two circular wedge profiles 54, 64, which pertains to both the dimensioning and the number of respective ramp and step areas, it is possible to push these two circular wedge profiles 54, 64 into one another in the direction of the central longitudinal axis L1, and the ignition area 46 will then dip into the ignition element mounting attachment 22. If the two circular wedge profiles 54, 64 are aligned with one another in the axial direction as well, the ignition element 30 is rotated in the ignition element mounting opening 28, namely, counterclockwise in the view in FIGS. 2 and 3, by a tool acting, for example, at a hexagonally designed tool action formation 70. This causes the step areas 58, 68, which are at first still located very close opposite each other in the pushed-in state, to move away from each other and to wedge the ramp areas 54, 64, which are located radially opposite each other in relation to one another. The state recognizable in FIG. 4 is now generated, in which openings 72 are formed between step areas 58, 68 located directly opposite each other in the circumferential direction and the ramp areas 56, 66 starting from and adjoining same. These openings are open towards both the inner volume area of the ignition element mounting attachment 22 and the ignition element mounting opening 28, i.e., they are also open towards the outside. These openings 72, which are likewise distributed uniformly over the circumference especially in case of the uniform circumferential distribution of the ramp areas and of the step areas at the two circular wedge profiles, make possible the entry of combustion air into the ignition element mounting attachment, doing so in a uniformly distributed manner over the circumference around the central longitudinal axis L1. It can thus become unnecessary to provide additional openings in the ignition element mounting attachment 22 itself, which would have to be prepared, for example, by drilling.

Consequently, locking of an ignition element at a combustion chamber housing, at an ignition element mounting attachment thereof in the example being shown, is generated in the design according to the present invention in a simple manner in terms of design by circular wedge profiles that can be brought into a self-locking wedged action with one another by rotating an ignition element. This makes it unnecessary to insert a thread into the ignition element mounting attachment or the combustion chamber housing. The circular wedge inner profile at the ignition element mounting attachment can be formed integrally during the manufacture of the combustion chamber housing, for example, in a casting or diecasting process. Based on the self-locking locking, there is actually no risk of detachment of the ignition element. It is necessary for this to act on the ignition element with a corresponding tool and to detach same. This also simplifies the process of replacing, e.g., a defective ignition element.

It shall be pointed out that the principles of the present invention may, of course, also be applied if the ignition element opening is not provided in an ignition element mounting attachment but, for example, directly in the circumferential wall or the bottom wall of the combustion chamber housing. A circular wedge inner profile could be provided there as well in an opening, for example, one formed in a casting operation. It shall also be pointed out that a combustion chamber housing as it is shown in FIG. 2 may, of course, also have more than one ignition element mounting attachment, for example, two or more ignition element mounting attachments, which may now have, if desired, the same design, i.e., they all may be provided with the circular wedge inner profile.

While specific embodiments of the invention have been shown and described in detail to illustrate the application of the principles of the invention, it will be understood that the invention may be embodied otherwise without departing from such principles.

What is claimed is:

1. A combustion chamber assembly comprising:

a combustion chamber housing with a housing wall surrounding a combustion chamber, an ignition element opening being provided in an area of said housing wall, said ignition element opening having a circular wedge inner profile; and an ignition element with a fastening area, said ignition element being fixed with said fastening area in said ignition element opening, said fastening area having a circular wedge outer profile that corresponds to said circular wedge inner profile and being fasteningly meshed with said circular wedge inner profile, wherein a combustion air inlet opening is formed between said circular wedge inner profile and said circular wedge outer profile that fasteningly meshes with said circular wedge inner profile.

2. A combustion chamber assembly in accordance with claim 1, wherein said ignition element opening is provided in the area of a circumferential wall of said housing wall.

3. A combustion chamber assembly in accordance with claim 1, wherein said housing wall has an ignition element mounting attachment open towards the combustion chamber and said ignition element opening is formed in said ignition element mounting attachment.

4. A combustion chamber assembly in accordance with claim 3, wherein said ignition element mounting attachment is provided with said circular wedge inner profile in an end area located away from said housing wall.

5. A combustion chamber assembly in accordance with claim 1, wherein said ignition element comprises an ignition area and said fastening area forms an end area of said ignition element and said ignition area extends starting from said fastening area.

6. A combustion chamber assembly in accordance with claim 1, wherein said combustion air inlet extends from a fluid intake to an ignition area of said ignition element, whereby fluid is delivered from said fluid intake to at least said ignition area via said combustion air inlet opening.

7. A combustion chamber assembly in accordance with claim 1, wherein said combustion air inlet opening defines at least a portion of a fluid transport path, wherein fluid is transported along said fluid transport path from said fluid intake to said combustion chamber.

8. A vehicle heater comprising:

a combustion chamber housing with a housing wall surrounding a combustion chamber, an ignition element opening being provided in an area of said housing wall, said ignition element opening having a circular wedge inner profile; and an ignition element with a fastening area and an ignition area, said ignition element being fixed with said fastening area in said ignition element opening, said fastening area having a circular wedge outer profile that corresponds to said circular wedge inner profile and being fasteningly meshed with said circular wedge inner profile, wherein a combustion air inlet opening is formed between said circular wedge inner profile and said circular wedge outer profile that fasteningly meshes with said circular wedge inner profile.

9. A vehicle heater in accordance with claim 8, wherein said ignition element opening is provided in the area of a circumferential wall of said housing wall.

10. A vehicle heater in accordance with claim 9, wherein said housing wall has an ignition element mounting attachment open towards the combustion chamber and said ignition element opening is formed in said ignition element mounting attachment.

11. A vehicle heater in accordance with claim 8, wherein said housing wall has an ignition element mounting attachment open towards the combustion chamber and said ignition element opening is formed in said ignition element mounting attachment, said combustion chamber being in fluid communication with said combustion air inlet opening.

12. A vehicle heater in accordance with claim 11, wherein said ignition element mounting attachment is provided with said circular wedge inner profile in an end area located away from said housing wall.

13. A vehicle heater in accordance with claim 8, wherein said fastening area forms an end area of the ignition element and said ignition area extends starting from the fastening area.

14. A vehicle heater in accordance with claim 8, wherein said combustion air inlet extends from a fluid intake to said ignition area, whereby fluid is delivered from said fluid intake to at least said ignition area via said combustion air inlet opening.

15. A vehicle heater in accordance with claim 8, wherein said combustion air inlet opening defines at least a portion of a fluid transport path, wherein fluid is transported along said fluid transport path from said fluid intake to said combustion chamber.

16. A combustion chamber assembly comprising:

a combustion chamber housing with a housing wall surrounding a combustion chamber, an ignition element opening being provided in an area of said housing wall, said ignition element opening having a circular wedge inner profile; and an ignition element with a fastening area and an ignition area, said ignition element being fixed with said fastening area in said ignition element opening, said fastening area having a circular wedge outer profile that corresponds to said circular wedge inner profile and being fasteningly connected with said circular wedge inner profile, said circular wedge inner profile and said circular wedge outer profile defining at least one combustion fluid inlet, wherein at least said ignition area receives fluid via said at least one combustion fluid inlet.

17. A combustion chamber assembly in accordance with claim 16, wherein said at least one combustion fluid inlet extends from a fluid intake to said ignition area, whereby said combustion chamber receives the fluid via said at least one combustion fluid inlet.

18. A combustion chamber assembly in accordance with claim 17, wherein said at least one combustion fluid inlet, said ignition area and said combustion chamber define at least a portion of a fluid transport flow path.

19. A combustion chamber assembly in accordance with claim 17, wherein said at least one combustion fluid inlet and said ignition area define at least a portion of a fluid transport flow path, wherein the fluid is delivered along said fluid transport flow path from said fluid intake to said combustion chamber.

20. A combustion chamber assembly in accordance with claim 16, wherein said combustion chamber is in fluid communication with said at least one combustion fluid inlet.

* * * * *